United States Patent [19]

Louwsma

[11] 4,404,925

[45] Sep. 20, 1983

[54] AIR HOSE GUIDE

[76] Inventor: Kevin R. Louwsma, 1019 Sarita St., Sanford, Fla. 32771

[21] Appl. No.: 200,903

[22] Filed: Oct. 27, 1980

[51] Int. Cl.[3] ..... B05C 11/00

[52] U.S. Cl. ..... 118/506; 137/377

[58] Field of Search ..... 188/32; 118/506; D12/217; D6/106; 137/351, 377

[56] References Cited

U.S. PATENT DOCUMENTS

D. 73,215 8/1927 Wessel ..... D6/106

OTHER PUBLICATIONS

Evans, E. S., *Drawings by Edward S. Evans, Auto Loading Expert,* p. 1, Feb. 24, 1917.

*Primary Examiner*—Evan K. Lawrence

*Attorney, Agent, or Firm*—Roger L. Martin

[57] ABSTRACT

A painter's air hose guide has a flat web portion with oppositely facing surfaces and a rear side edge that is adapted to be wedged between the supporting surface for a vehicle wheel and its tire tread. A pair of flanges are symmetrically joined to the web portion so as to provide a contact surface for the air hose at the forefront of the guide structure and a ground contacting means for supporting the web in an inclined position regardless of which of the oppositely facing surfaces confronts the ground in a position assumed by the guide structure when it is dropped for insertion in its working position by foot movement of the worker.

6 Claims, 5 Drawing Figures

10
15
18
24
25
11
43
42
12
30
13
33
39
21
20
40
19
31
37
27
34

10
55
15
16
46
5
51
47
30
22
11
39
50
48
28
52
20
19
40
31
27

10
17
23
11
39
54
48
55
30
43
36
42
5
19
12
15
13
28
55
18
53
22
16

AIR HOSE GUIDE

BACKGROUND OF THE INVENTION

This invention relates to an air hose guide and more particularly to an air hose guide for use by painters of motor vehicles, such as automobiles.

The conventional method for painting an automobile involves the use of a paint sprayer that is hand manipulated by the worker or painter and attached by an air hose to a pressurized source of air, such as an air compressor. As the painter moves about the work area, the air hose is dragged along the floor or other supporting surface for the vehicle and it frequently becomes wedged in the space between the tread of one of the vehicle tires and the supporting surface therefor. This interrupts the free movement of the air hose and is a source of considerable aggravation to the worker because uniform application of the paint to the body surface of the vehicle requires an uninterrupted sweeping movement of the sprayer being manipulated by the worker. Apart from this, considerable time is involved in repeatedly freeing the air hose from its wedged position at the base of the tires.

SUMMARY OF THE INVENTION

The inventor has developed an air hose guide for insertion and use in the space between the tire tread of the wheel of the vehicle being painted and the supporting surface therefor. The guide has a flat planar web portion with a transversely extending rear side edge that is wedged during use into the space between the tire tread and support surface so as to maintain the guide in place during its many encounters with the air hose during the process of painting the vehicle. The web portion has oppositely facing surfaces and along the front side edge of the web portion, the inventor provides a flange portion at each surface and these flanges are designed to support the web portion in a forwardly inclined position that enables the guide to be wedged in place upon being dropped to the floor area and regardless of which surface faces the ground or supporting surface for the vehicle when thus dropped. The flange portions are arranged to provide a surface along the front side edge of the web portion for contact by the air hose as it is dragged along the ground or vehicle supporting surface in the vicinity of the tire.

In accord with certain aspects of the invention, the guide surface has an arcuately concaved, vertical contour which serves to prevnt the hose from creeping up the contact surface and into contact with the tire tread above the guide when the air hose is being pulled by the worker. In accord with other aspects of the invention, the front side edge of the web portion has a convexly curved medial edge of the forefront of the guide and a pair of rearwardly and laterally extending side edge portions. This facilitates a flange arrangement for guiding the air hose away from the opposite sides of the tire as well as for guiding the air hose away from entry into the space between the tread and supporting surface in front of the tire. In accord with other aspects of the invention, the flanges have outer edges that are arranged in planes that intersect the plane of the web portion along a common line behind its rear side edge. These edges are arranged to contact the ground or supporting surface for the vehicle and to support the web in an inclined position that facilitates its movement into a wedging position between the tire tread and supporting surface with a minimum amount of effort and without the need for bending over to hand manipulate the guide into a proper position to accomplish its intended function.

The hose guide may be made of rigid material that will withstand breakage in the event the vehicle is inadvertently caused to roll over the hose guide structure. Preferably, however, the guide is a product molded from material that provides resiliently deformable structural portions that can be deformed if the vehicle is caused to roll over the guide but nevertheless regain its original shape thereafter. For example, the guide may be molded from natural or synthetic rubber producing materials or from other suitable synthetic resinous materials which are moldable into a suitably resiliently deformable structure of the kind contemplated.

A general object of the invention is to provide an air hose guide for use at the base of a vehicle wheel to prevent a painter's air hose from becoming obstructed between the tire tread and supporting surface of the vehicle. Yet another object is to provide a guide of the type contemplated and which can be simply dropped on the floor of the work area and manipulated into a position for use by the worker's foot. Yet another object is to provide a hose guide of the type contemplated and which can be simply dropped on the floor of the work area and caused to assume an appropriate position on the supporting surface that requires nothing more than manipulation by the foot of the worker to place it in an operative position. Yet another object of the invention is to provide an inexpensive air hose guide which can be used with tires of varying diameter and width. Yet another object is to provide an air hose guide of the type contemplated and which can be readily manufactured by conventional molding procedures.

BRIEF DESCRIPTION OF THE DRAWINGS

The novel features which are believed to be characteristic of this invention are set forth with particularity in the appended claims. The invention, itself, however, both as to its organization and method of operation, together with further objects and advantages thereof, may best be understood by reference to the following description taken in connection with the accompanying drawings, wherein:

DESCRIPTION OF PREFERRED EMBODIMENT

Reference is now made to the drawings and wherein the air hose guide is generally designated at 10. It includes a flat, planar web portion 11 and a pair of flange portions 12 and 13 that are fixed to and integrally joined to the web portion 11 in the process of forming the hose guide structure by conventional molding procedures.

Figure 2:
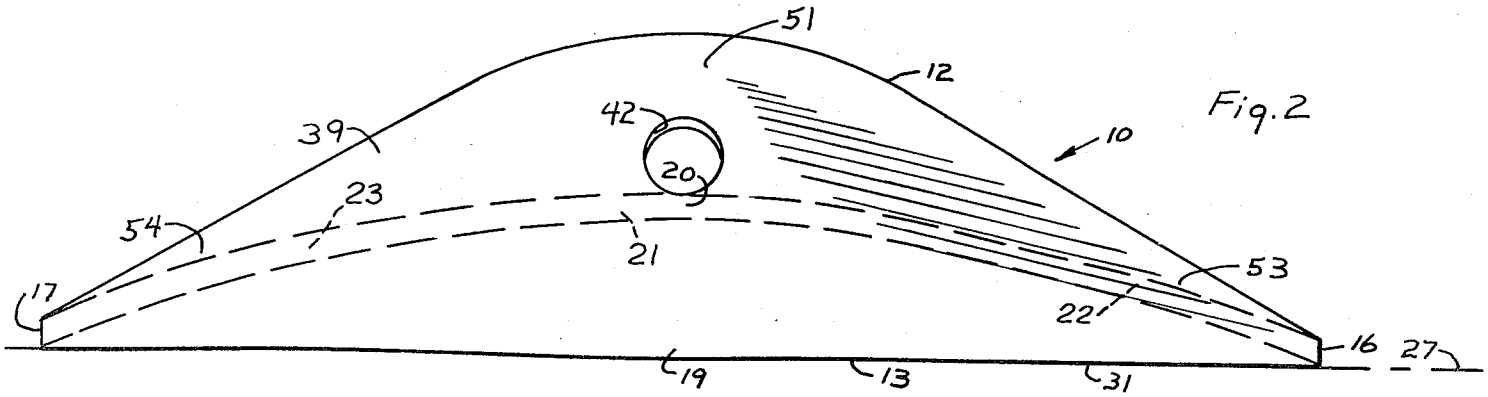
FIG. 2 is a front elevational view of the air hose guide as seen when resting on the support surface.

At the back side 18 of the air hose guide 10, the web portion 11 has a rear wide edge 15 that extends transversely between the opposite sides 16 and 17 of the guide structure 10. At the front side 19 of the air hose guide 10, the web portion 11 has a transversely extending front side edge 20. In the integrally formed structural arrangement of the preferred embodiment illustrated in the drawings, this front side edge 20 is a transversely extending area that falls between the projections forwardly to the hose contacting surface 39 at the front side 19 of the hose guide of the planar surfaces 24 and 25 of web 11. These projections are illustrated by the broken lines shown in FIG. 2. This side edge 20 has a convex arcuately curved center or medial portion 21 at the forefront of the guide structure 10 and a pair of opposite side edge portions 22 and 23. These side edge portions 22 and 23 merge with the medial portion 21 therebetween and diverge rearwardly and laterally thereof to the opposite side extremities 16 and 17 of the guide structure 10. The flat web portion 11 also has a pair of oppositely facing surfaces 24 and 25 that are generally oriented and located between the front and rear side edges 20 and 15 thereof.

Figure 5:
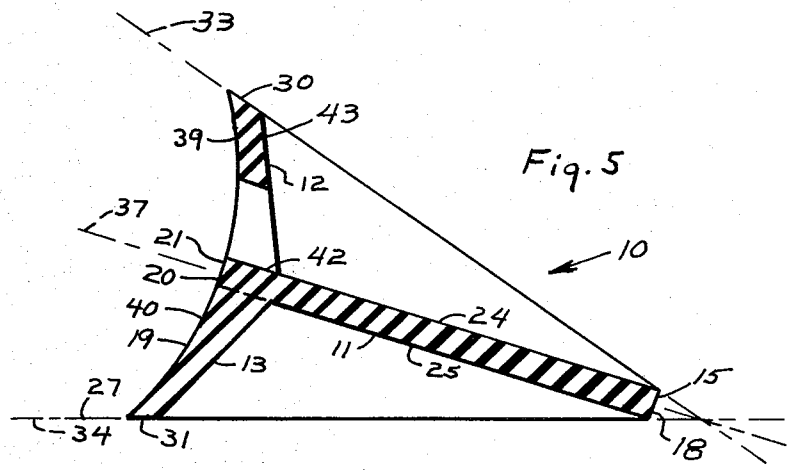
FIG. 5 is a transverse sectional view in elevation along the lines 5—5 of FIG. 1.
Figure 1:
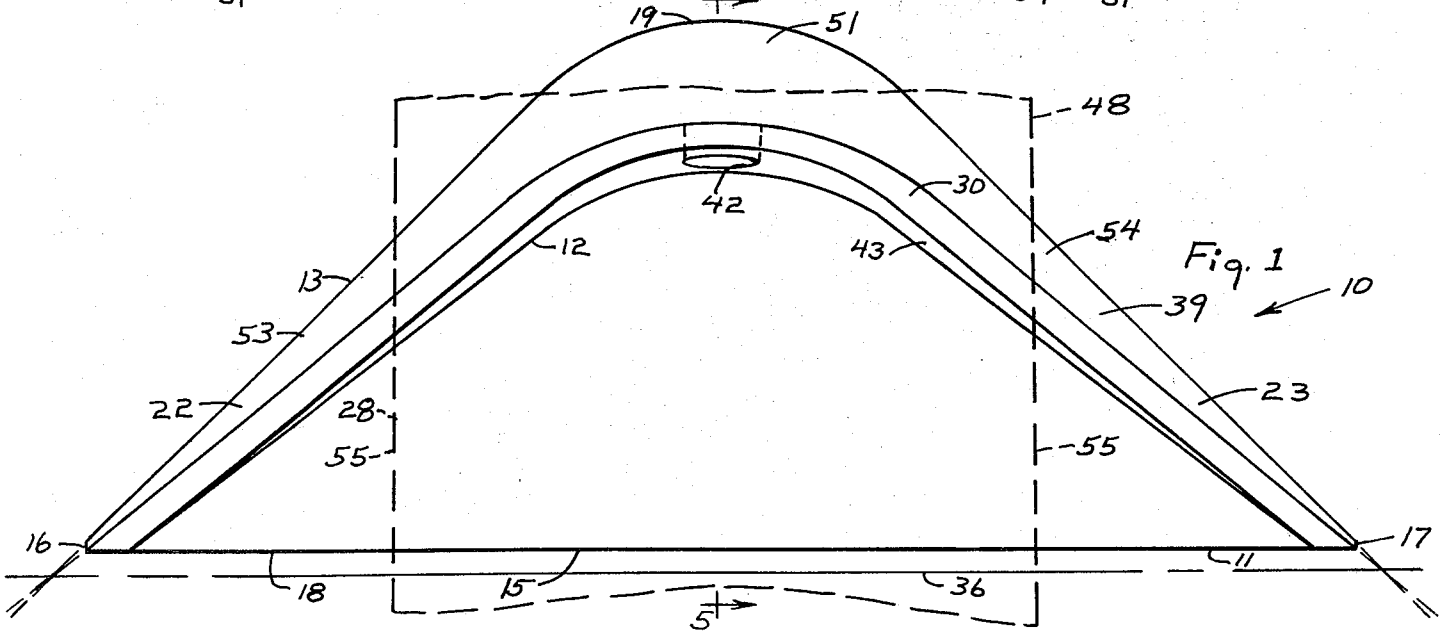
FIG. 1 is a top plan view of an air hose guide embodying the principles of the invention, as seen when resting on the supporting surface for a wheel of an automotive vehicle, a fragment of the tire being shown in broken lines as well as a common line for intersection of certain planes involving parts of the hose guide.
Figure 3:
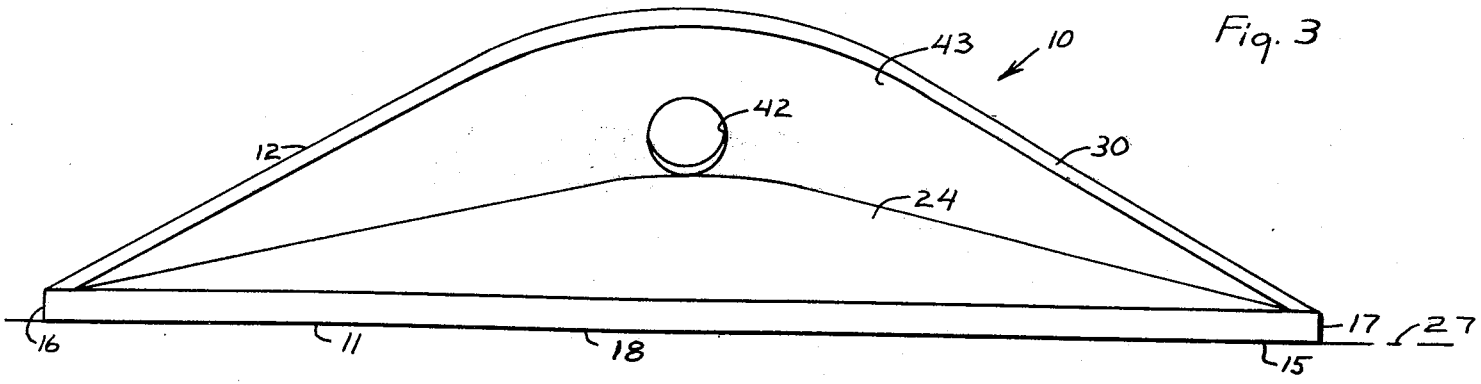
FIG. 3 is a rear elevational view of the guide as seen when resting on the support surface, a fragment of an automobile tire being shown in broken lines therein.

The flange portions 12 and 13 of the guide structure 10 extend along the front side edge 20 of the web portion 11 and they respectively project laterally outwardly of the upwardly and downwardly facing surfaces 24 and 25 of the web portion. Each flange is adapted and arranged to rest upon the supporting surface 27 for the guide and wheel 28 of the vehicle so as to support the web portion 11 in a forwardly inclining position that facilitates a positioning of the guide in reference to the vehicle tire without regard for which of the two surfaces 24 and 25 facially confront the supporting surface 27 after the guide has been dropped to the floor area and in the vicinity of its intended use. To this end, the flanges 12 and 13 are substantially identical in shape and are joined to and symmetrically arranged with respect to the web portion 11. The flanges 12 and 13 are provided with outer edges 30 and 31 and these edges are adapted and arranged to contact the supporting surface 27 when the flange associated therewith is resting on the surface 27. The edges 30 and 31 are located in respective planes 33 and 34 which intersect the plane of the web portion 11 along a common line 36 that is parallel to and rearwardly offset from the rear side edge 15 of the web portion 11 as generally illustrated in FIGS. 1 and 5.

In addition to the web supporting function, the flange portions 12 and 13 are adapted and arranged along the front side edge 20 to provide a hose contact 39 that extends transversely between the opposite sides 16 and 17 of the guide 10 for guiding movement of any air hose that contacts the surface 39. This contact surface 39 has an arcuately concaved, vertical contour 40 throughout the span of the distance 39 between the opposite sides 16 and 17 of the guide structure 10.

Flange 12 has a hole 42 that extends between the contact surface 39 and rear face 43 of the flange. This hole 42 is of sufficient size for a worker to insert a finger therethrough so as to hand manipulate the guide from the forefront thereof when the need arises.

The air hose guide structure 10 is preferable a molded structure in which the flange and web portions are resiliently deformable so as to recover their original shape if the guide is inadvertently deformed by movement of a vehicle wheel thereover.

Figure 4:
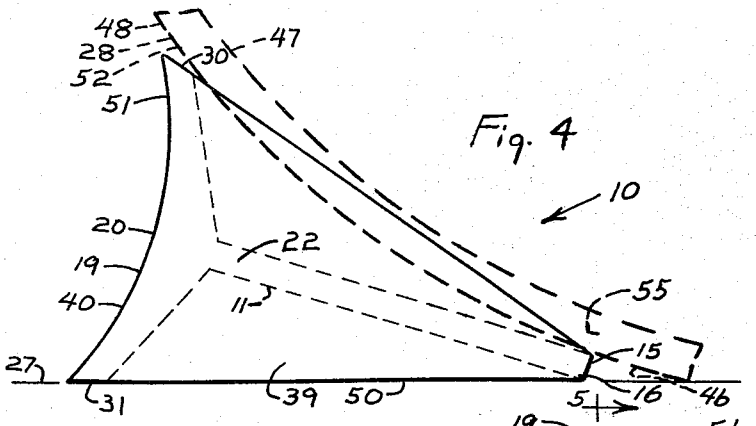
FIG. 4 is a side elevational view of the air hose guide, with certain parts being shown in phantom and in relation to a fragment of an automobile tire also shown in broken lines.

For use in the environment contemplated, the guide is simply dropped on the floor or other supporting surface 27 for the vehicle and then manipulated by the worker's foot into a position at which the rear side edge 15 of the web portion 11 faces the converging space 46 between the floor 27 and the tire tread 47 of the vehicle wheel 28. With the guide thus positioned, the guide is then struck with the worker's foot on the contact surface 39 at the front side 19 so as to drive the rear side edge 15 of the web into a wedged working position 50 (see FIG. 4) between the supporting surface 27 for the vehicle wheel 28 and the tread 47 of the tire 48.

One of the advantages of the structural arrangement is that the air hose guide 10 will in the vast majority of instances assume a position at which one of the surfaces 24 or 25 confronts the wheel supporting surface 27 after the guide has been dropped to the floor area. As such, flange portion 12 will assume a resting position on the surface 27 and support the web portion 11 in an inclined position if surface 24 confronts surface 27 after the guide structure 10 has been dropped while flange portion 13 will support the web portion 11 in the inclined position and rest on the supporting surface 27 if surface 25 confronts the wheel supporting surface 27 after the guide is dropped.

The flange arrangement also has certain other advantages. For example, the center portion 51 of the contact surface 39 that includes the convexly curved medial portion 21 of the front side edge serves to prevent an air hose from contacting the face 52 of the tire tread 47 in the converging space 46 while the opposite side portions 53 and 54 of the contact surface 39 along the opposite side edge portions 22 and 23 serve to lap the opposite side edges 55 of the tire tread 47 when the guide 10 is in a working position and this provides a shield to movement of the air hose into a wedged relationship with the tire at the side of the tire.

The concave vertical contour 40 also provides certain advantages. For example, the force pulling an air hose around an obstacle is most instances is one which is upwardly inclined and this has a tendency to cause the air hose to travel upwardly on a surface contacted thereby. With the concave vertical contour, however, there is greater resistance of this upward movement of the hose along the contact surface and into a position of greater resistance to such movement with the tire tread.

While only a certain preferred embodiment of this invention has been shown and described by way of illustration, many modifications will occur to those skilled in the art and it is, therefore desired that it be understood that it is intended herein to cover all such modifications that fall within the true spirit and scope of this invention.

What is claimed as new and what it is desired to secure by Letters Patent of the United States is:

1. A paint sprayer air hose guide for use between the tire tread of a wheel of a vehicle being spray painted and the supporting surface therefor, said air hose guide comprising a flat planar web portion having a transversely extending rear side edge that is adapted and arranged to be wedged between said supporting surface and said tire tread, a transversely extending front side edge that is generally forwardly offset from said rear side edge, and a pair of oppositely facing surfaces that are generally located between the rear and front side edges of the web portion, a first flange portion which extends along said front side edge and projects laterally of one of said oppositely facing surfaces, said first flange portion being adapted and arranged to rest upon said supporting surface and support the web portion in a forwardly inclining position when said one of said oppositely facing surfaces confronts said supporting surface, a second flange portion which extends along said front side edge and projects laterally of the other of said oppositely facing surfaces, said second flange portion being adapted and arranged to rest upon said supporting surface and support the web portion in a forwardly inclining position when said other of said oppositely facing surfaces confronts said supporting surface, said first and second flange portions being adapted and arranged to provide a transversely extending air hose contact surface along said front side edge for guiding movements of an air hose thereat, said first flange portin having an edge that is adapted and arranged to contact said supporting surface when said first flange portion is resting thereon, said second flange portion having an edge that is adapted and arranged to contact said supporting surface when said second flange portion is resting thereon, and the edges of the first and second flange portions being located in respective planes which intersect the plane of the web portion along a line that is located in back of the rear side edge thereof.

2. An air hose guide for use between the tire tread of a wheel of a vehicle being painted and the supporting surface therefor in accord with claim 1 wherein said first and second flange portions are symmetrically arranged with respect to said planar web portion and are formed integral therewith.

3. An air hose guide for use between the tire tread of a wheel of a vehicle being painted and the supporting surface therefor in accord with claim 2 wherein flange portions and said web portion are resiliently deformable and are integrally formed from molded plastic material.

4. A paint sprayer air hose guide for use between the tire tread of a wheel of a vehicle being spray painted and the supporting surface therefor, said air hose guide comprising a flat planar web portion having a transversely extending rear side edge that is adapted and arranged to be wedged between said supporting surface and said tire tread, a transversely extending front side edge that is generally forwardly offset from said rear side edge, and a pair of oppositely facing surfaces that are generally located between the rear and front side edges of the web portion, a first flange portion which extends along said front side edge and projects laterally of one of said oppositely facing surfaces, said first flange portion being adapted and arranged to rest upon said supporting surface and support the web portion in a forwardly inclining position when said one of said oppositely facing surfaces confronts said supporting surface, a second flange portion which extends along said front side edge and projects laterally of the other of said oppositely facing surfaces, said second flange portion being adapted and arranged to rest upon said supporting surface and support the web portion in a forwardly inclining position when said other of said oppositely facing surfaces confronts said supporting surface, said first and second flange portions being adapted and arranged to provide a transversely extending air hose contact surface along said front side edge for guiding movements of an air hose thereat, said front side edge having a pair of transversely spaced apart, rearwardly and laterally diverging opposite side edge portions, and a convexly curved medial edge portion that is located between said opposite side edge portions and merges therewith, and said first and second flange portions being adapted and arranged along the front side edge of the web portion to provide an arcuately concave vertical contour in the contact surface.

5. A paint sprayer air hose guide for use between the tire tread of a wheel of a vehicle being spray painted and the supporting surface therefor, said air hose guide comprising a flat planar web portion having a transversely extending rear side edge that is adapted and arranged to be wedged between said supporting surface and said tire tread, a transversely extending front side edge that is generally forwardly offset from said rear side edge, and a pair of oppositely facing surfaces that are generally located between the rear and front side edges of the web portion, a first flange portion which extends along said front side edge and projects laterally of one of said oppositely facing surfaces, said first flange portion being adapted and arranged to rest upon said supporting surface and support the web portion in a forwardly inclining position when said one of said oppositely facing surfaces confronts said supporting surface, a second flange portion which extends along said front side edge and projects laterally of the other of said oppositely facing surfaces, said second flange portion being adapted and arranged to rest upon said supporting surface and support the web portion in a forwardly inclining position when said other of said oppositely facing surfaces confronts said supporting surface, said first and second flange portions being adapted and arranged to provide a transversely extending air hose contact surface along said front side edge for guiding movements of an air hose thereat, said first flange portion having a rear face and a hole which extends between said contact surface and said rear face and is adapted to receive a finger for manipulating the guide.

6. A paint sprayer air hose guide for use between the tire tread of a wheel of a vehicle being spray painted and the supporting surface therefor said hose guide comprising a resiliently deformable flat planar web portion which has a transversely extending rear side edge that is adapted and arranged to be wedged between said tire tread and said supporting surface, a transversely extending front side edge that is generally forwardly offset from said rear side edge, and a pair of oppositely facing surfaces that are generally located between the rear and front side edges of the web portion, a resiliently deformable first flange portion which extends along said front side edge and projects laterally of one of said oppositely facing surfaces, said first flange portion being integrally joined to said web portion along said front side edge and being adapted and arranged to rest upon said supporting surface and support the web portion in a forwardly inclining position when said one of said oppositely facing surfaces is arranged to confront said supporting surface, a resiliently deformable second flange portion which extends along said front side edge and projects laterally of the other of said oppositely facing surfaces, said second flange portion being integrally joined to said web portion along said front side edge and being adapted and arranged to rest upon said supporting surface and support the web portion in a forwardly inclining position when the other of said oppositely facing surfaces is arranged to confront said supporting surface, said first flange portion having an edge that is adapted and arranged to contact said supporting surface when said first flange portion is resting thereon, said second flange portion having an edge that is adapted and arranged to contact said supporting surface when said second flange portion is resting thereon, the edges of said first and second flange portions being located in respective planes which intersect the plane of the web portion along a line that is located in back of the rear side edge thereof, said front edge having a pair of transversely spaced apart, rearwardly and laterally diverging opposite said edge portions, and a convexly curved medial edge portion that is located between said opposite side edge portions and merges therewith, said first and second flange portions being symmetrically arranged with respect to the web portion and adapted and arranged to provide a transversely extending air hose contact surface along said front side edge for guiding movements of an air hose thereat, said contact surface having an arcuately concave vertical contour along said front side edge, and one of said first and second flange portions having means for receiving a finger to manipulate the hose guide.

* * * * *

UNITED STATES PATENT AND TRADEMARK OFFICE

CERTIFICATE OF CORRECTION

PATENT NO. : 4,404,925

DATED : Sep. 20, 1983

INVENTOR(S) : Kevin R. Louwsma

It is certified that error appears in the above-identified patent and that said Letters Patent are hereby corrected as shown below:

Column 1, Line 50, "prevnt" should read -- prevent --;
Column 3, Line 5, "wide" should read -- side --;
Line 54, insert "surface" after -- contact --;
Column 5, Line 17, "portin" should read -- portion --;
Line 35, insert "said" after -- wherein --;

Signed and Sealed this

Sixth Day of December 1983

[SEAL]

Attest:

GERALD J. MOSSINGHOFF

Attesting Officer

Commissioner of Patents and Trademarks